US005639982A

United States Patent [19]

Cipolla

[11] Patent Number: 5,639,982

[45] Date of Patent: Jun. 17, 1997

[54] MEANS TO FIRE A FULLY AUTOMATIC GUN UNDERWATER USING A SPECIAL BARREL CLEARANCE BLANK ROUND

[75] Inventor: Jeffrey L. Cipolla, Newport, R.I.

[73] Assignee: The United States of America as represented by the Secretary of the Navy, Washington, D.C.

[21] Appl. No.: 664,320

[22] Filed: May 23, 1996

[51] Int. Cl.[6] ..... F41F 3/07; F41C 9/06

[52] U.S. Cl. ..... 89/1.11; 89/1.1; 42/1.14

[58] Field of Search ..... 89/1.11, 1.1; 42/1.14

[56] References Cited

U.S. PATENT DOCUMENTS

| | | | |
|---|---|---|---|
| 1,271,640 | 7/1918 | Wentling | 89/5 |
| 3,300,888 | 1/1967 | Belcher et al. | 42/1.14 |
| 3,417,719 | 12/1968 | Nitenson | 114/20.1 |
| 3,453,763 | 7/1969 | Barr et al. | 42/59 |
| 3,476,048 | 11/1969 | Barr et al. | 102/399 |
| 3,494,060 | 2/1970 | Hendricks | 42/65 |
| 3,677,132 | 7/1972 | Plenge | 89/14.2 |
| 3,721,031 | 3/1973 | Falterman et al. | 42/1.14 |
| 4,077,147 | 3/1978 | Donnard et al. | 42/1.14 |
| 4,266,358 | 5/1981 | Phillips et al. | 42/39.5 |
| 4,357,888 | 11/1982 | Phillips et al. | 114/20.1 |
| 4,742,775 | 5/1988 | Harris | 102/456 |
| 4,821,441 | 4/1989 | Castro, Jr. et al. | 42/1.14 |

*Primary Examiner*—Michael J. Carone
*Assistant Examiner*—Matthew J. Lattig
*Attorney, Agent, or Firm*—Michael J. McGowan; Prithvi C. Lall; Michael F. Oglo

[57] ABSTRACT

A method of firing an automatic weapon in an underwater environment is disclosed. The automatic weapon includes a barrel having a muzzle end and a chamber within the barrel. The method includes the steps of loading a blank round of ammunition into the chamber, first detonating the blank round of ammunition, creating gas and steam within the chamber as a result of detonating the blank round of ammunition, commingling expanded gas and steam to form a bubble at the muzzle end of the barrel, thereby displacing water from the chamber of the barrel and forming a dry environment throughout the chamber of the barrel, loading at least one live round of ammunition into the chamber, and detonating and firing the at least one live round of ammunition from within the dry environment prior to dissipation of the bubble.

8 Claims, 2 Drawing Sheets

MEANS TO FIRE A FULLY AUTOMATIC GUN UNDERWATER USING A SPECIAL BARREL CLEARANCE BLANK ROUND

STATEMENT OF GOVERNMENT INTEREST

The invention described herein may be manufactured and used by or for the government of the United States of America for governmental purposes without the payment of any royalties thereon or therefor.

BACKGROUND OF THE INVENTION (1) Field of the Invention

This invention generally relates to a method and apparatus for firing a fully automatic gun underwater using a special blank round.

(2) Description of the Prior Art

Underwater guns firing fully automatically have come under consideration in naval applications recently for swimmer operations, mine clearance, anti torpedo close-in defense, and other uses. These proposed uses have been supported by the development of extremely low drag super-activating projectiles, which allow ranges and velocities comparable to conventional guns fired in air. Design of the weapon remains a problem, particularly if it is intended to fire fully automatically (i.e., like a machine-gun). Propellants designed to accelerate a projectile down a barrel can generate catastrophic pressure levels if the barrel is full of water at firing. Consequently, some means must be devised to keep the barrel clear of water during the firing of live rounds. Proposals to date have involved complex mechanical systems adding weight and expense to the gun system. The present invention does not alter the mechanical operation of the gun, adds no parts, and relies on the blank round to clear the barrel.

Known methods and apparatuses for firing an automatic weapon underwater so as to obtain a "dry barrel" firing are limited to the capping of a gun's barrel and include the following:

U.S. Pat. No. 1,271,640 to Wentling discloses an underwater weapon which prevents water from entering the barrel by the use of valve 21 at the end of the barrel. A fired bullet opens the valve as it exits the barrel. A mechanism is provided to shut the valve after the bullet exits the valve but before the water enters the barrel.

U.S. Pat. No. 3,300,888 to Belcher et al. discloses an underwater gun which is sealed with a plastic cap 46 at the end of its barrel. The gun fires when it is struck against an object in a spearing motion. When the end of the barrel strikes an object, the telescoping barrel collapses and the firing pin strikes the cartridge thus firing the bullet. The bullet flies through the dry barrel and blows the cap 46 off. A new cap must be affixed and another cartridge must be loaded after every shot and this must be done out of the water.

U.S. Pat. No. 3,453,763 to Barr et al. discloses an underwater pistol capable of holding several cartridges. Each cartridge forms its own dry disposable barrel that is elongated and sealed at both ends. The pistol can be reloaded underwater and can fire multiple shots.

U.S. Pat. No. 3,476,048 to Barr et al. disclose cartridges for use with the gun disclosed in Barr et al. U.S. Pat. No. '763. The cartridges each form their own dry disposable barrels and are elongated and sealed at both ends.

U.S. Pat. No. 3,494,060 to Hendricks discloses an underwater gun having a plug 121 that is broken when the round is fired. The gun must be reloaded out of the water and capped with a new plug before being fired again.

U.S. Pat. No. 4,077,147 to Donnard et al. discloses an underwater pistol which uses an expendable cartridge-barrel. The one-shot, sealed cartridge-barrel is loaded into the gun and fired. Upon firing, a seal 51 at the end of the barrel is broken. The weapon can be reloaded underwater.

U.S. Pat. No. 4,266,358 to Phillips et al. discloses an underwater firearm having a large magazine for holding multiple shots that are spring loaded in the firing chamber.

U.S. Pat. No. 4,357,888 to Phillips et al. discloses special ammunition for use with the firearm of Phillips et al. U.S. Pat. No. '358. The projectiles are self-propelled such that upon firing, the propellant in the projectile is ignited and continues to provide propulsion after the projectile exits the firearm.

The above devices are substantially unacceptable for solving the problem of repeated underwater firing of a conventional weapon without the use of special caps and/or valves therein.

SUMMARY OF THE INVENTION

Therefore, it is an object of this invention to address the problem of firing a gun underwater fully automatically.

Another object of this invention is to provide a fully automatic gun in which there is alternately loaded blank barrel clearance and live rounds, such that a clear blank round is first detonated before firing the live round.

Still another object of this invention is to utilize the blank barrel clearance rounds interspersed with the live round to create a gas bubble for displacing any water present in the gun barrel prior to discharging the live round.

Still another object of this invention is to provide virtually any automatic weapon with underwater firing capabilities simply by using the alternating blank barrel clearance rounds and live rounds of the present invention.

In accordance with one aspect of this invention, a standard automatic weapon fired underwater with the barrel filled with water may fail catastrophically. This invention alleviates that problem by using a special blank round alternately interspersed with at least one live round, the blank round ballistics being designed to specifically clear the barrel of water and generate a gas bubble or "pocket" at the end of the muzzle of sufficient duration to allow the firing of at least one subsequent live round into that gas pocket.

The new blank round/automatic underwater gun would thus fire continually, using a combination of alternating live and blank barrel clearance rounds.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and of which:

DESCRIPTION OF THE PREFERRED EMBODIMENT

As generally shown in FIGS. 1–5 there is illustrated a portion of an automatic weapon including, for example, a barrel portion 18 having a muzzle end 19, the weapon being placed in an underwater environment 16.

The particular type of water, whether sea (salt) water or fresh water will not affect the nature of the invention and the term "underwater" is, therefore, intended to encompass either fresh or salt water. Only a portion of the automatic weapon is shown and it should be understood that virtually any type of automatic or repeating weapon is suitable for use with the present invention.

Figure 1:
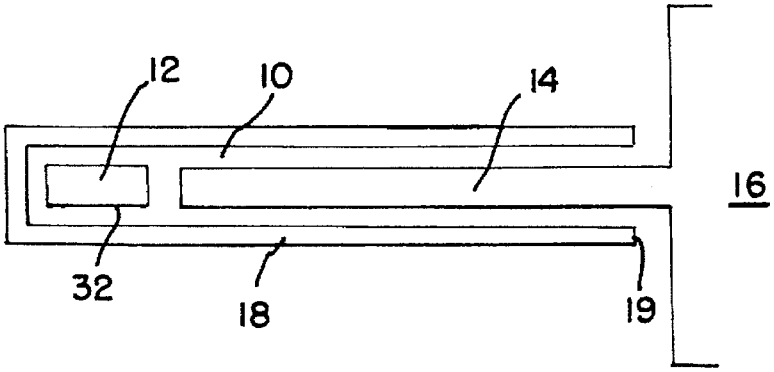
FIG. 1 illustrates a flooded barrel for an automatic weapon with a barrel clearance blank in a chamber thereof.
Figure 2:
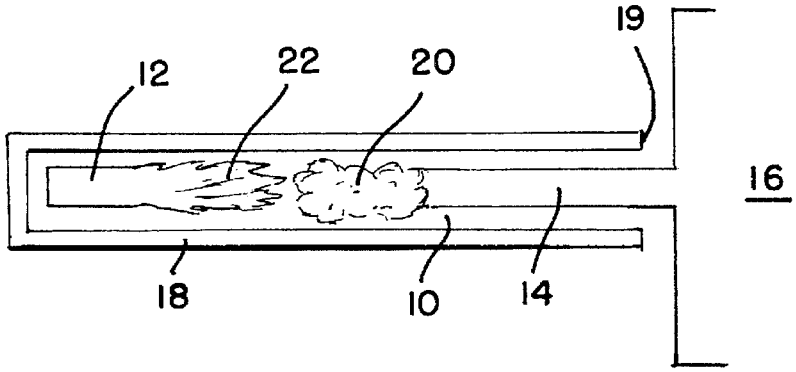
FIG. 2 illustrates gas and steam present in the weapon chamber after detonating the barrel clearance blank.
Figure 3:
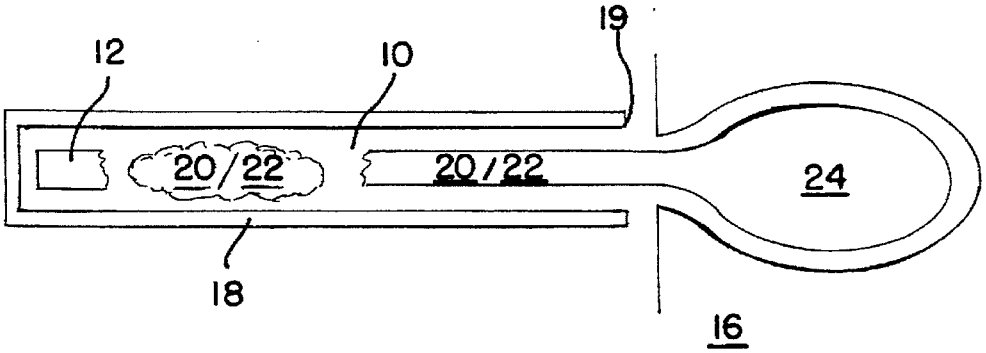
FIG. 3 illustrates formation of a bubble at the end of the muzzle due to presence of gas and steam.

Referring first to FIGS. 1 through 3, the barrel 18 includes a chamber 10 formed therein. A charge 12 of gunpowder or other solid liquid or gaseous propellant suitable for detonating blank rounds of ammunition is contained within a shell casing 32 and the shell casing is housed within the chamber 10. By way of explanation, the combination of the shell casing 32 having the charge 12 therein is referred to as a barrel-clearance-blank (BCB) round. The water 16 from the exterior of the barrel 18 which floods into the barrel is generally shown at 14 in FIGS. 1 through 3. The shell casing per se may be unnecessary for some propellant embodiments envisioned, such as gases or solids.

Figure 4:
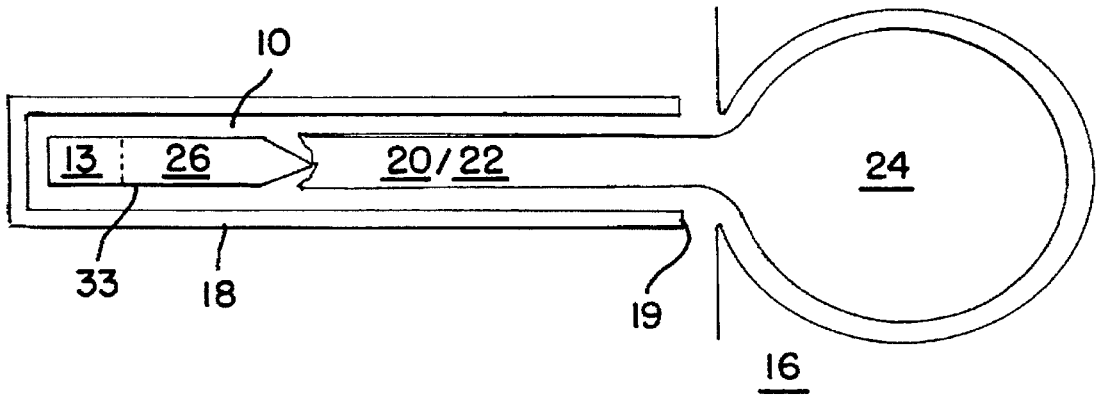
FIG. 4 illustrates the presence of a live round in the chamber after creation of the bubble.
Figure 5:
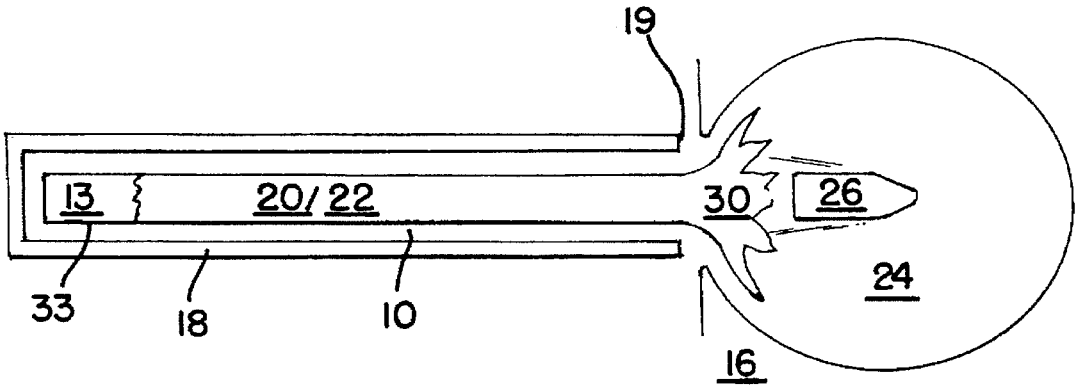
FIG. 5 illustrates the firing of a live round into the bubble created by the barrel clearance blank round pre-fired from the weapon.

Before firing, it is assumed that the barrel is flooded as at 14 and the BCB round is in the chamber as shown in FIG. 1. The combustion ballistics of the charge 12 of this BCB round are tailored to the problem of accelerating the liquid mass of water in the barrel 18 and converting some of the liquid mass to steam 20. Thus, in general, the BCB round may have completely different ballistics from a live or projectile-firing round used as shown in FIGS. 4 and 5 below.

The BCB round fires, such that the charge 12 generates a volume of pressurized, high-temperature combustion products 22 and some additional volume of pressurized steam 20 as shown in FIG. 2. A mixture of these two gases accelerates the remaining liquid volume 14 down the barrel 18 at peak pressures low enough to ensure the structural integrity of both the barrel 18 and the chamber 10.

Thus, upon explosion of the charge 12, there is created both steam 20 in connection with the water 14, and gas products 22 adjacent the charge 12. Due to expansion of the gases 20 and 22 as compared to the fluid in the chamber of the barrel 18, the water 14 is pushed to the muzzle end of the barrel toward the underwater environment 16.

Within a specified period of time, depending upon the type and amount of charge 12 in the BCB round, the steam 20 and gas 22 commingle into a single mixture and expand outward at the muzzle end of the barrel 18 to form a bubble or gas pocket 24 as shown in FIG. 3. In other words, shortly after the liquid 14 clears the muzzle end 19 of the barrel 18, the bubble 24 of gas, steam and combustion products will form at the muzzle end 19 of the barrel 18, keeping water from reentering the chamber 10 as shown in FIG. 3 for a short period of time.

The volume of the by-products from charge 12 of the BCB round is tailored to maintain this bubble 24 long enough to chamber and fire a live (projectile) round as shown in FIG. 4. The charge 12 of the BCB round may, in fact, have time-varying burn rates to optimally fulfill the dual roles of ejecting the liquid water 14 and maintaining a bubble 24 at the muzzle end 19 of the barrel 18.

As further shown in FIGS. 4 and 5, a charge 13 of gunpowder or other solid liquid or gaseous propellant suitable for discharging a projectile 26 in live rounds of ammunition is formed within a different shell casing 33 and the live round is loaded into the chamber 10 subsequent to firing of the BCB round.

Immediate loading of the live round, including the projectile 26 and charge 13 housed within the casing 33 as shown in FIG. 4, effectively allows for discharge of the live round of ammunition in a waterless environment. In particular, the bubble 24 shown in the figures remains for a brief period of time, thus maintaining the barrel 18 evacuated of water 14, such that the live round may be discharged in a dry environment.

The projectile 26 leaves the barrel 18 and flies through the gas bubble 24 as shown in FIG. 5, such that the charge 13 adds its own combustion products 30 to the bubble 24 and heats the surrounding water 16, adding steam to the bubble 24.

The cycle repeats by chambering and firing either another BCB round, or another live round. In either case, the combustion of the propellant 12 or 13 at each firing is sufficient to sustain the presence of a liquid-free barrel 18 and a bubble 24 at the muzzle end 19 of the barrel 18 for the period of time needed to load and fire the next round.

The automatic gun described here functions as a standard machine gun would in air, and can use suitable reload mechanisms. It requires no modification of the barrel, chamber, or reload/firing mechanism over standard designs and no additional mechanisms. The barrel is kept clear of water dynamically during the firing process through the cyclic use of special BCB round. Consequently, machine gun designs currently in use or a simple modification thereof can be rapidly and inexpensively adapted for underwater use through this means.

Alternatives are foreseen in the areas of optimized parameters for the BCB round, including adaptation of the burn rates and flame temperatures of the propellant. These parameters may be modified for different types of weapons, different barrel lengths, different operating depths, and different rates of fire. The BCB round may be sequenced in series with live rounds as a belt, chain, box, or linkless feed system or may be fed through as a separate (dual) feed mechanism.

In addition, the properties of the temporary bubble produced at the muzzle by the BCB round may be improved (increased in pressure, prolonged in duration) by the addition of various special mechanical devices at the muzzle. For example, a rigid open ended can, or open-ended bellmouth device, or other means for retaining propellant gases to keep the barrel clear may be employed.

In light of the above, it is therefore understood that within the scope of the appended claims, the invention may be practiced otherwise than as specifically described.

What is claimed is:

1. A method of firing an automatic weapon in an underwater environment, said automatic weapon including a barrel having a muzzle end, and a chamber within the barrel, said method comprising the steps of:

loading a blank round of ammunition into the chamber;

first detonating the blank round of ammunition within the chamber;

creating a gas and steam within the chamber as a result of said step of first detonating;

commingling expanded gas and steam to form a bubble at the muzzle end of the barrel, thereby displacing water from the chamber of the barrel and forming a dry environment throughout the chamber of the barrel;

loading at least one live round of ammunition into the chamber; and detonating and thereby firing the at least one live round of ammunition within the dry environment prior to dissipation of the bubble.

2. A method of firing an automatic weapon in an underwater environment, said automatic weapon including a barrel having a muzzle end and a chamber within the barrel, said method comprising the steps of:

detonating a blank round of ammunition within the barrel, thereby forming a dry environment within the barrel; and detonating and firing at least one live round of ammunition from the barrel subsequent to the step of detonating the blank round of ammunition, thereby firing the at least one live round of ammunition in a dry environment.

3. The method according to claim 2, further comprising the steps of:

creating a gas and steam combination within the chamber as a result of said step of detonating a blank round; and commingling expanded gas and steam to form a bubble at the muzzle end of the barrel, thereby displacing water from the chamber of the barrel and forming a dry environment throughout the chamber of the barrel.

4. The method according to claim 3, wherein said step of detonating and firing at least one live round of ammunition is prior to dissipation of the bubble at the muzzle end of the barrel.

5. A device for firing an automatic weapon in an underwater environment, said automatic weapon including a barrel having a muzzle end, and a chamber within the barrel, said device comprising:

a blank round of ammunition first loaded in the chamber;

at least one live round of ammunition loaded behind said blank round of ammunition in the chamber;

means for first detonating the blank round of ammunition, thereby producing gas and steam within the chamber;

means for forming a gas bubble at the muzzle end of the barrel, thereby displacing water from the chamber of the barrel and forming a dry environment throughout the chamber of the barrel; and means for detonating and firing the at least one live round of ammunition within the dry environment prior to dissipation of the gas bubble.

6. The device according to claim 5, wherein said means for first detonating the blank round of ammunition includes detonation of a first charging component housed within the chamber of said barrel.

7. The device according to claim 6, wherein said means for detonating and firing the at least one live round of ammunition includes detonation of a second charging component within the chamber of said barrel.

8. The device according to claim 5, wherein said means for forming a gas bubble is by the commingling of the steam and gas within the chamber of the barrel.

* * * * *